United States Patent [19]

Tomkinson

[11] 4,083,270

[45] Apr. 11, 1978

[54] AIR MOTOR HAVING ANGULAR DISPLACEMENT CONTROL MEANS

[75] Inventor: Jerry P. Tomkinson, Livonia, Mich.

[73] Assignee: Desoutter, Inc., Livonia, Mich.

[21] Appl. No.: 778,865

[22] Filed: Mar. 18, 1977

[51] Int. Cl.[2] ..... B25B 19/00

[52] U.S. Cl. ..... 81/52.4 R

[58] Field of Search ..... 81/54, 52.4 R; 173/20; 73/259, 88 F

[56] References Cited

U.S. PATENT DOCUMENTS

| | | | |
|---|---|---|---|
| 1,002,139 | 8/1911 | Drisko | 73/259 |
| 3,011,480 | 12/1961 | Vilmerding | 81/52.4 R |
| 3,368,396 | 2/1968 | Van Burkleo et al. | 81/52.4 R |
| 3,454,111 | 7/1969 | Wiess | 81/52.4 R |
| 3,996,800 | 12/1976 | Rosso | 73/231 |

*Primary Examiner*—James L. Jones, Jr.

*Attorney, Agent, or Firm*—Charles W. Chandler

[57] ABSTRACT

A power tool operated by an air motor having a rotor with radially moving vanes, and means for counting the vanes passing an electro-magnetic sensor mounted on the motor housing. A valve connected to the counter is operative to terminate rotation of the motor and the tool when the vanes corresponding to a predetermined angle of rotation have passed adjacent the sensor.

5 Claims, 2 Drawing Figures

AIR MOTOR HAVING ANGULAR DISPLACEMENT CONTROL MEANS

BACKGROUND OF THE INVENTION

This invention is related to air motors employed for rotating objects, such as a wrench employed to impart a fastening motion to a nut, and more specifically, to an air motor having means responsive to the angular displacement of the rotor for terminating rotation of the nut after it has been rotated through a predetermined angular displacement.

There are many industrial applications which a fastener, such as a nut, must be rotated on a stem to a particular position. For example, the adjusting nut mounted on the valve train of an internal combustion engine is adjusted according to the motion desired of an engine valve. In an automated process, the nut is usually tightened by an air motor having a wrench that engages the nut, then turns the nut to a predetermined tightened position.

One of the conventional practices for terminating rotation of the nut is to provide a torque-responsive means that responds to the elongation of the threaded stem on which the nut is mounted for de-activating the air motor. The location of the nut on the stem depends upon the nut's position when the rotation of the air motor is terminated. The variance between nuts mounted in such an automated process often varies within a range of plus or minus 90° with respect to the desired rotated position.

SUMMARY OF THE INVENTION

The broad purpose of the present invention is to provide means for more precisely controlling the rotated position of the rotor with respect to the motor housing when the rotor rotation is terminated, by providing a counter that registers a value as each rotor vane passes a sensing device mounted on the motor housing. Since the rotor vanes are spaced at regularly spaced angular positions, the counter is effectively measuring the total angular displacement of the rotor. When the vanes corresponding to a predetermined angular displacement have passed the sensing device, a solenoid valve actuated by the counter terminates air flow to the air motor.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
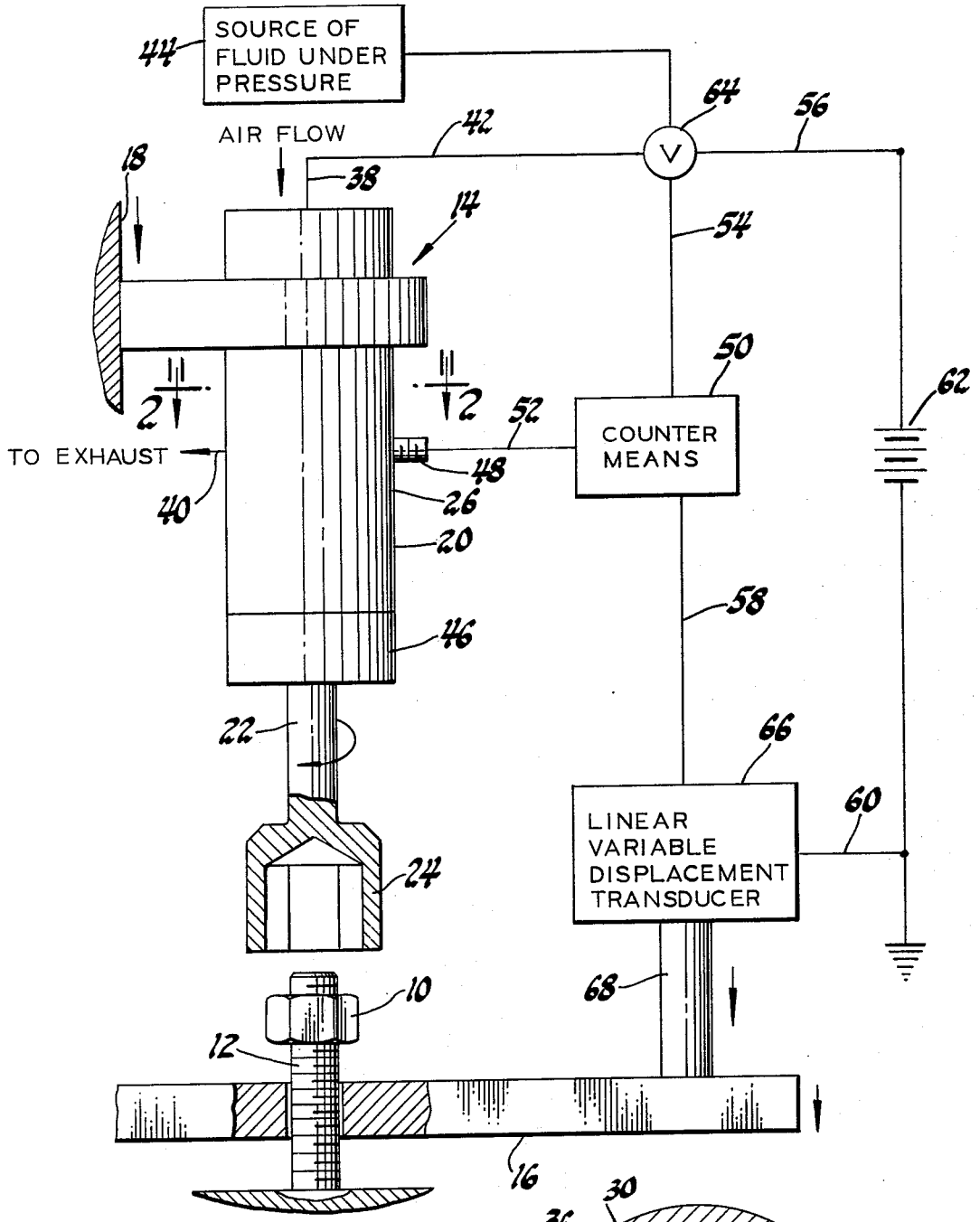
FIG. 1 is a schematic view of an air motor suited for locating a fastener on a threaded stem in accordance with the preferred embodiment of the invention.
Figure 2:
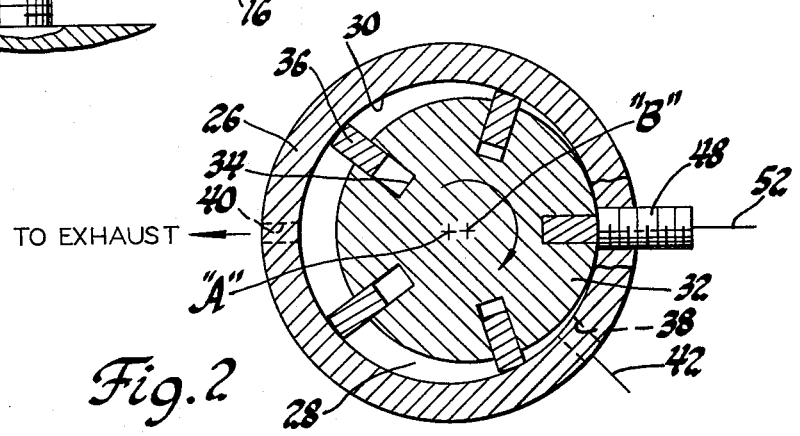
FIG. 2 is an enlarged cross-sectional view through the air motor housing of FIG. 1 as viewed along lines 2—2.

Referring to the drawing, FIG. 1 illustrates a nut 10 mounted on a threaded stem 12. Power tool means 14 is adapted to be operatively connected to nut 10 to rotate it to a predetermined position along stem 12 in order to locate a member 16 with respect to a mechanism not shown. Power tool 14 includes a movable fixture means 18 supporting an air motor 20 for raising and lowering the air motor with respect to stem 12.

Air motor 20 is rotationally connected to a rotor 22 carrying a socket wrench 24 adapted to engage nut 10. Air motor 20 has a housing 26 enclosing a power chamber 28 which includes a cylindrical wall 30. Wall 30 is formed about an axis illustrated at "A". Rotor 22 is connected to a rotor body 32 disposed in the power chamber to rotate therein about an axis indicated at "B", parallel to and spaced from axis "A".

Body 32 has a series of annularly spaced slots 34 formed at regular angular intervals about axis "B". A plurality of vanes 36, each disposed in one of the slots 34, are mounted in the chamber so as to be radially movable in their respective slots as body 32 is being rotated.

Power chamber 28 has an inlet 38 and an outlet 40. Referring to FIG. 1, inlet 38 is connected by conduit means 42 to a source of fluid under pressure 44. The connection is such that as pressurized air passes through power chamber 28, the air imparts a rotational motion to the rotor body and the vanes before being exhausted through outlet 40.

Preferably body 32 is connected by gear reduction means 46 to rotor 22 so it rotates one rotation for each two hundred rotations of the rotor body.

An electro-magnetic sensing device 48 is mounted on housing 26 adjacent the path of rotation of the vanes. The vanes are of a conventional plastic non-magnetic material, however, body 32 is of magnetic material so that as each vane passes electro-magnetic device 48, each vane slot causes device 48 to actuate a counter means 50 through a connection 52. Counter means 50 is connected by means 54, 56, 58, and 60 to a source of electrical energy 62.

A solenoid valve 64 is connected to conduit 42 between source 44 and the counter means in such a manner that when the counter means reaches a predetermined value, it actuates valve 64 to block fluid flow from source 44 to conduit 42 thereby terminating rotation of rotor body 32.

The angular position of wrench 24 can be terminated such that the final rotated position of nut 10 on stem 12 can be positioned to within plus or minus 5° of a particular rotational position on stem 12 because of the responsiveness of the counter means to the passage of the vanes in the power chamber. For example, with five vanes in the housing, and gear reduction means 46 having a 200-1 reduction ratio, the counter means will be actuated one thousand times for each rotation of nut 10. When the counter means achieves a particular value, it actuates valve 64 to thereby terminate rotation of rotor 22 and nut 10 with a greater precision than can be achieved with conventional means.

In practice, a linear variable displacement transducer 66 is connected to the counter means. Transducer 66 has a spring biased member 68 engaged with member 16 such that until nut 10 has displaced member 16 to a predetermined initial position, counter means 50 is inoperative. The transducer then actuates the counter so that the nut is only rotated through a predetermined angular displacement to its final rotated position on the stem.

Other means can be employed in place of transducer 66 for initially rendering counter means 50 inoperative until nut 10 has been located to an initial position. For example, the air motor can employ a transducer sensitive to the initial torque applied to the nut. The initial torque may be about five foot pounds as the nut is being initially rotated until it contacts member 16. Upon making such contact, the torque necessary to turn the nut increases because of the resistance of member 16. The transducer is arranged so that it is sensitive to an increase in torque, for example, to eight foot pounds at which time it would signal the counter to commence its vanecounting function. Mechanical calipers can also be employed for actuating the counter when the nut has reached a predetermined position on the stem. Still other devices can be used for signalling the counter to respond to the vanes passing electro-magnetic device 48.

It is to be understood that although the embodiment of the invention is illustrated with respect to locating a nut on a stem, the invention can also be employed in other applications in which an air motor is used to precisely position an object in rotated position with respect to another object.

I claim:

1. A power tool, comprising:

an air motor having a housing, said housing having a power chamber including a cylindrical wall formed about a first axis, rotor means mounted in the housing so as to be rotatable about a second axis spaced from and parallel to said first axis, a tool member connected to the rotor so as to be rotated therewith, a plurality of vanes, said vanes being mounted on the rotor means in regularly spaced angular intervals and engaging the cylindrical wall of the power chamber as said rotor is being rotated, a source of fluid under pressure and means for connecting said source to the power chamber for rotating said rotor means and said vanes as pressurized fluid is being passed through the chamber, sensing means mounted on the housing adjacent the path of motion of the vanes, counter means connected to the sensing means so as to be actuated as a vane passes said sensing means, and valve means connected between the source of fluid and the power chamber for blocking fluid flow to said power chamber and means connecting the counter means to the valve means for actuating same to block fluid flow to the power chamber when the counter means registers a predetermined value, whereby the tool member is rotated through only a predetermined angle of rotation.

2. A power tool as defined in claim 1, including means for rendering the counter means inoperative as the rotor is being rotated.

3. A power tool as defined in claim 1, in which the tool member is operative to impart a tightening motion to a fastener as the tool member is being rotated.

4. A power tool as defined in claim 1, in which the tool member is operative to impart a tightening motion to a fastener as the tool member is being rotated, and including first means responsive to a predetermined tightened condition of the fastener, and second means connecting the counter means to said first means for actuating the counter means at a predetermined tightened condition of the fastener.

5. A power tool, comprising:

an air motor having a housing, said housing having a power chamber including a cylindrical wall formed about a first axis, a rotor mounted in the housing so as to be rotatable about a second axis spaced from the parallel to said first axis, a tool member operative to engage a fastener for a tightening motion, said tool member being connected to the rotor to be rotated therewith, a plurality of vanes, a source of fluid under pressure and means for connecting said source to the power chamber for rotating said rotor and said vanes as pressurized fluid is being passed through the chamber, said rotor having a plurality of slots disposed in regularly spaced angular intervals about said second axis, slot being suited for receiving a vane such that the vane is moved in a radial direction as the rotor is being rotated, electro-magnetic means mounted on the housing adjacent the path of motion of the rotor slots, counter means connected to the electro-magnetic means so as to be actuated in response to the motion of a rotor slot adjacent said electro-magnetic means, valve means connected between the source of fluid and the power chamber for blocking fluid flow to said power chamber, and means connecting the counter means to the valve means for actuating same to block fluid flow to the power chamber when the counter means registers a predetermined value, whereby the tool member is rotated through only a predetermined angle of rotation in accordance with the predetermined value of the counter means.

* * * * *